US008082912B2

(12) United States Patent
Wood

(10) Patent No.: US 8,082,912 B2
(45) Date of Patent: Dec. 27, 2011

(54) METHOD FOR CONTROLLING SUPPLY OF COMPRESSED GASSES TO A FIRING CHAMBER OF A PAINTBALL MARKER

(75) Inventor: Jack Kingsley Wood, Chesire (GB)

(73) Assignee: Planet Eclipse Limited, Trafford Park, Manchester (GB)

( * ) Notice: Subject to any disclaimer, the term of this patent is extended or adjusted under 35 U.S.C. 154(b) by 123 days.

(21) Appl. No.: 12/347,010

(22) Filed: Dec. 31, 2008

(65) Prior Publication Data

US 2009/0173331 A1 Jul. 9, 2009

Related U.S. Application Data

(60) Provisional application No. 61/018,681, filed on Jan. 3, 2008.

(51) Int. Cl.
*F41B 11/00* (2006.01)

(52) U.S. Cl. ..... 124/77

(58) Field of Classification Search ..... 124/71–77
See application file for complete search history.

(56) References Cited

U.S. PATENT DOCUMENTS

| | | | | | |
|---|---|---|---|---|---|
| 2,581,758 | A * | 1/1952 | Galliano et al. | ..... | 124/75 |
| 2,634,717 | A * | 4/1953 | Junkin | ..... | 124/75 |
| 3,773,025 | A * | 11/1973 | Roeder et al. | ..... | 124/75 |
| 4,770,153 | A * | 9/1988 | Edelman | ..... | 124/72 |
| 4,819,609 | A * | 4/1989 | Tippmann | ..... | 124/72 |
| 5,063,905 | A * | 11/1991 | Farrell | ..... | 124/72 |
| 5,881,707 | A * | 3/1999 | Gardner, Jr. | ..... | 124/77 |
| 5,967,133 | A * | 10/1999 | Gardner, Jr. | ..... | 124/77 |
| 6,035,843 | A * | 3/2000 | Smith et al. | ..... | 124/77 |
| 6,138,656 | A * | 10/2000 | Rice et al. | ..... | 124/73 |
| 6,474,326 | B1 * | 11/2002 | Smith et al. | ..... | 124/77 |
| 6,532,949 | B1 * | 3/2003 | McKendrick | ..... | 124/77 |
| 6,889,681 | B1 * | 5/2005 | Alexander et al. | ..... | 124/72 |
| 6,889,682 | B2 * | 5/2005 | Styles et al. | ..... | 124/77 |
| 7,603,997 | B2 * | 10/2009 | Hensel et al. | ..... | 124/77 |
| 7,806,112 | B2 * | 10/2010 | Benetti et al. | ..... | 124/70 |
| 2003/0024520 | A1 * | 2/2003 | Dobbins | ..... | 124/73 |
| 2003/0024521 | A1 * | 2/2003 | Smith et al. | ..... | 124/77 |
| 2005/0028802 | A1 * | 2/2005 | Jones | ..... | 124/73 |
| 2005/0145235 | A1 * | 7/2005 | Jong | ..... | 124/73 |
| 2005/0268894 | A1 * | 12/2005 | Styles et al. | ..... | 124/74 |
| 2006/0005823 | A1 * | 1/2006 | Quinn et al. | ..... | 124/73 |
| 2007/0039601 | A1 * | 2/2007 | Jong | ..... | 124/73 |
| 2007/0169766 | A1 * | 7/2007 | Hensel et al. | ..... | 124/77 |
| 2007/0181115 | A1 * | 8/2007 | Jong | ..... | 124/73 |
| 2008/0011284 | A1 * | 1/2008 | Styles et al. | ..... | 124/77 |

OTHER PUBLICATIONS

About Air Compressors.com, "Draw a 5/2 air valve; step by step", http://www.about-air-compressors.com/draw-a-5-2.html.

Ezine Articles, "What's a 2/2 Copressed Air Valve?", http://ezinearticles.com/?Whats-a-2/2-Compressed-Air-Valve?&id=269586&opt=print.

Ezine Articles, "What's a 3/2 Compressed Air Valve?", http://ezinearticles.com/?What's-a-3/2-Compressed-Air-Valve?&id=284715&opt=print.

* cited by examiner

*Primary Examiner* — Troy Chambers

(74) *Attorney, Agent, or Firm* — Barlow, Josephs & Holmes Ltd.

(57) ABSTRACT

A pneumatic circuit for a paintball marker is disclosed. Paintball markers generally include a gas supply, a bolt mechanism and a firing chamber. The pneumatic circuit includes an exhaust path. A gas supply inlet path is in fluid communication to the gas supply. A first supply path is in fluid communication with the gas supply inlet path and the bolt mechanism. A second supply path is in fluid communication with the gas supply inlet path and the firing chamber. A first valve is configured and arranged to selectively control fluid communication of the first supply path and the exhaust path. A second valve is configured and arranged to control fluid communication of the second supply path.

14 Claims, 3 Drawing Sheets

Circuit Diagram for Basic Solenoid Controlled Firing Chamber Filling Utilizing a 5/2 Valve for Bolt Control and Valve Filling Circuit Diagram for Solenoid Controlled Firing Chamber Filling Utilizing a 3/2 Valve for Bolt Control and 2/2 Valve for Firing Chamber Filling

METHOD FOR CONTROLLING SUPPLY OF COMPRESSED GASSES TO A FIRING CHAMBER OF A PAINTBALL MARKER

CROSS-REFERENCE TO RELATED APPLICATIONS

The present patent document claims priority to earlier filed U.S. Provisional Application Ser. No. 61/018,681, filed Jan. 3, 2008, the entire contents of which are incorporated herein by reference.

BACKGROUND OF THE INVENTION

1. Field of the Invention

The present invention relates generally to pneumatic firing systems and more specifically to a method for controlling supply of compressed gasses to a firing chamber of a paintball marker.

2. Background of the Related Art

In some types of paintball markers it is beneficial to control the supply of compressed gasses into a firing chamber or valve chamber. Some markers are designed so that the bolt is in contact with a sealing member that prevents transfer of gas from the firing chamber, through the bolt, to the ball in the breech. Transfer of gasses is only allowed to occur once the bolt has moved forward, pushing the projectile into the firing position, and closing off the projectile feed tube to the breech. At this point the compressed gasses are free to pass the sealing member, through the bolt, and fire the projectile. With the bolt fully forward and communication of the gasses from the firing chamber, past the sealing member, through the bolt to the breech, it is beneficial to the performance of the marker to prevent further supply of compressed gas into the firing chamber. Once the bolt is in the forward firing position, any subsequent flow of gasses from the supply, through the firing chamber, through the bolt and down the barrel, is wasted, un-required gas. However, once the bolt is retracted and the sealing member engaged by the bolt, the supply needs to be opened to the firing chamber in order for the firing chamber to be filled ready for the next firing cycle to commence.

In some existing markers the gas supply is shut off from the firing chamber during firing by means of sealing members within the firing chamber controlled by the position of the bolt. For example, a valve mechanism attached to, or in communication with, the bolt mechanism that opens and closes as the bolt cycles between the firing and the loading positions.

However, these mechanisms are undesirable because they add weight and size to the body of the marker, and size and weight to the bolt mechanism. Additionally, these mechanisms are more complex because they rely on numerous seals, which can malfunction and cause the marker to be less reliable.

Accordingly, there is a need from an improved method of controlling gasses in a paintball marker that minimizes waste gas. There is a further need for an improved method of controlling gasses in a paintball marker that is more consistently reliable and that does not increase the weight and size or complexity of a paintball marker.

SUMMARY OF THE INVENTION

The present invention solves the problems of the prior art by providing a pneumatic circuit to replace the existing more complicated mechanisms for opening and closing the gas supply to the firing chamber during the firing cycle. The pneumatic circuit of the present invention utilizes a high-flow valve that operates independently of the bolt mechanism, to open and close the supply of gas to the firing chamber. Ideally this valve would be an electronically controlled solenoid valve, operated by the same electronic circuit board that controls other functions within the marker, such as bolt actuation.

In its most simplistic form, the same solenoid valve that is used to operate the bolt mechanism can also be utilized to allow communication between the supply gasses and the firing chamber.

The pneumatic circuit of the present invention provides more accurate control and more adjustability of the opening and closing of the supply gasses to the firing chamber.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENT

Figure 1:
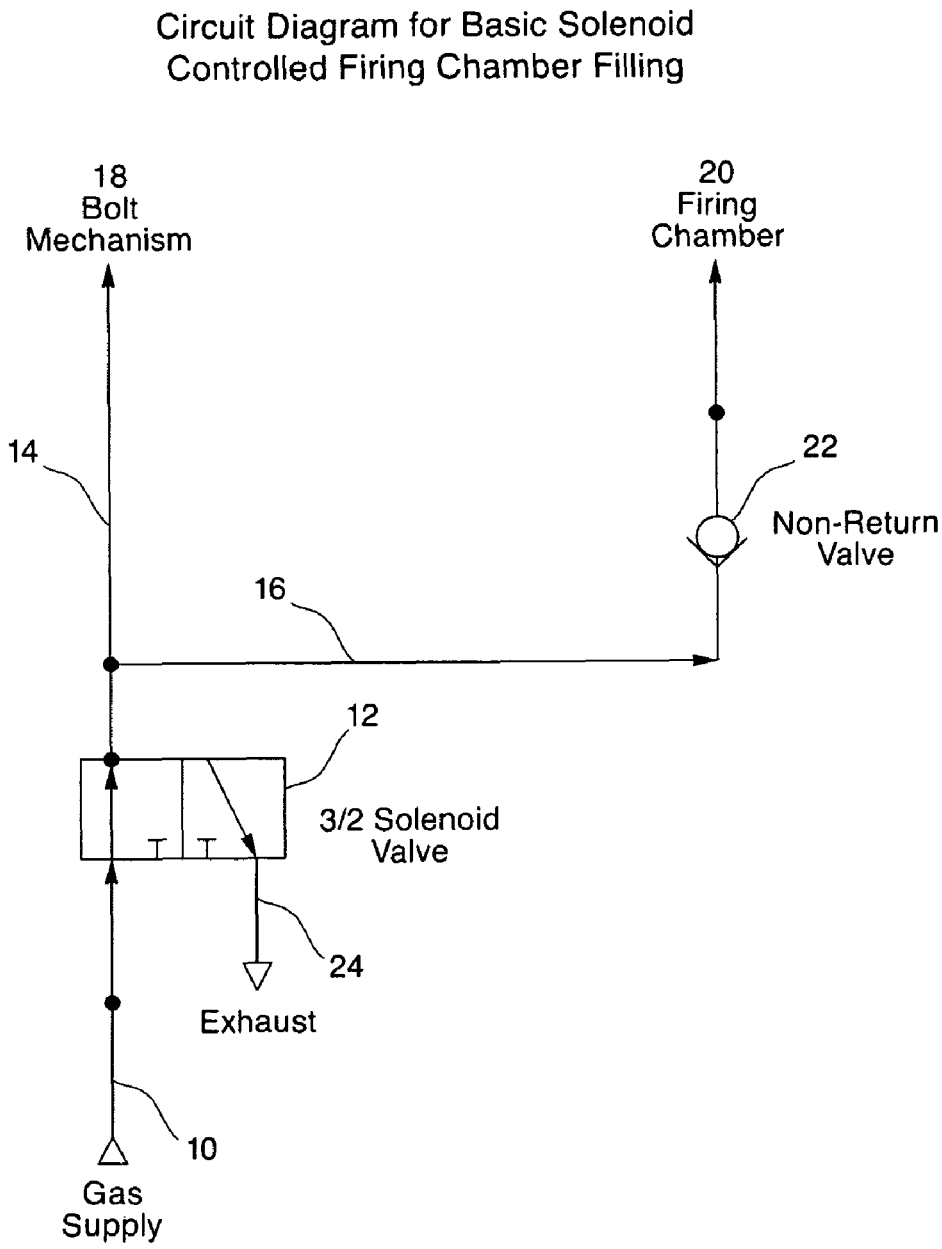
FIG. 1 is a diagram of a pneumatic circuit of the method of the present invention.

Referring now to FIG. 1, a basic pneumatic circuit diagram of the method of the present invention is shown generally. Gasses are supplied 10 directly into a control valve 12 via a compressed gas supply, such as a compressed gas tank, for example. The control valve 12 may be a 3/2 solenoid valve with a normally open function, however, other types of solenoid valves may be used. Through the control valve 12 the pneumatic circuit splits into 2 separate branches 14, 16. One branch 14 supplies the bolt mechanism 18 and the second branch 16 supplies the firing chamber 20. A second valve 22 is in line with the second branch 16 and firing chamber 20, which will be further described below.

When the control valve 12 is activated the gas from the bolt mechanism 18 is allowed to exhaust to atmosphere through the control valve 12 to the exhaust 24. This feature allows the bolt mechanism 18 to move forward, which loads a projectile into the firing position and allows communication of gas from the firing chamber 20 to the breech and the projectile.

When the control valve 12 is activated, the gas inside the firing chamber 20 is prevented from exhausting through the control valve 12 due to position of the second valve 22, which may be a non-return valve. However, the second valve 22 may be other types of valve as described in the other embodiments below.

All the gas inside the firing chamber 20 is used to fire the projectile while the bolt mechanism 18 is in its firing position. When the bolt mechanism 18 is in the firing position, and the control valve 12 is actuated, no gas is supplied to the firing chamber (4). When the control valve 12 deactivated, the bolt mechanism 18 is returned to its loading position and the firing chamber 20 is re-filled ready for the next firing cycle.

Figure 2:
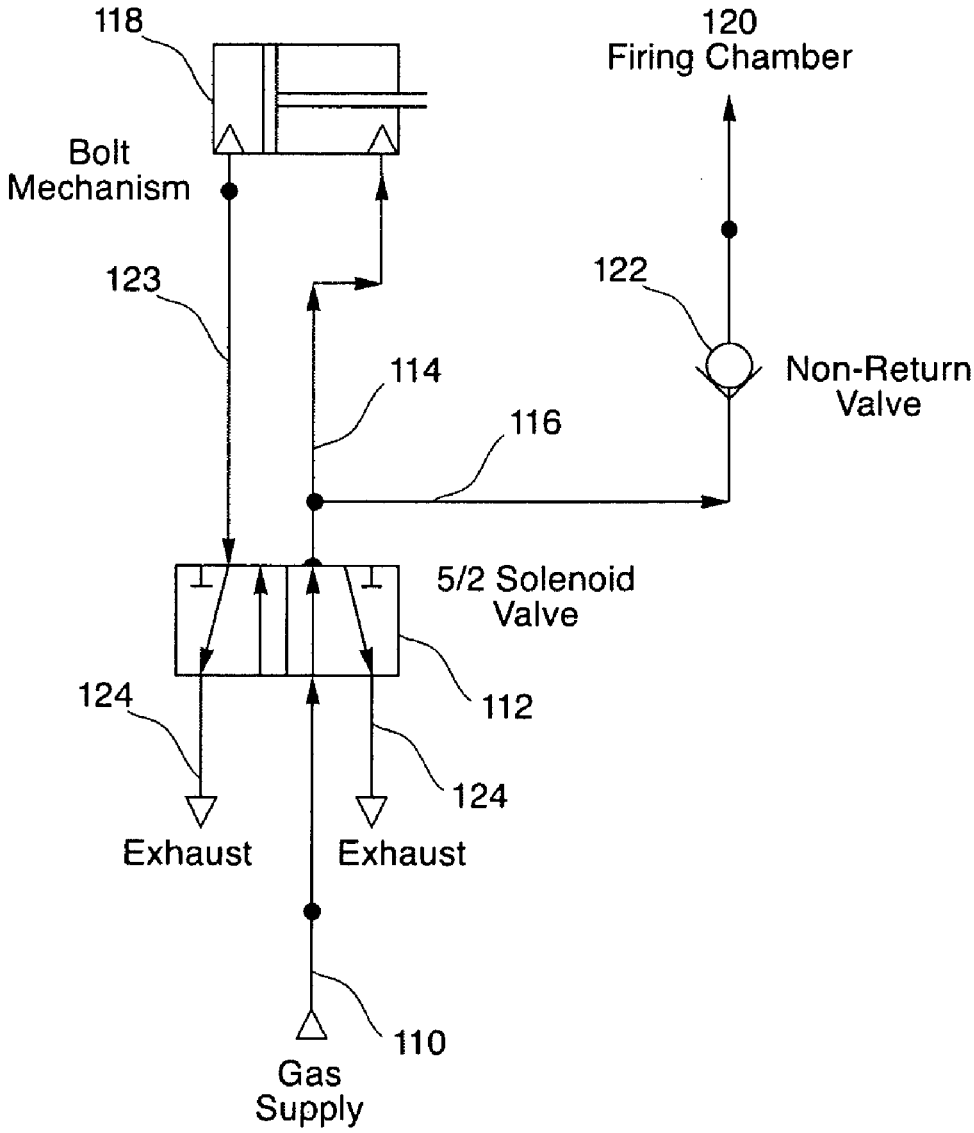
FIG. 2 is a diagram of a second embodiment of the pneumatic circuit of the method of the present invention.

Referring now to FIG. 2, a pneumatic circuit diagram of a second embodiment the method of the present invention is shown generally. Gasses are supplied 110 directly into a control valve 112 via a compressed gas supply. In this embodiment, the control valve 112 is a 5/2 solenoid valve with a normally open function. Through the control valve 112 the pneumatic circuit supplies the front of the bolt mechanism 118 via air path 114 and the firing chamber 120 via air path 116 from the first port of the 5/2 valve and the rear of the bolt mechanism 118 via air path 123. A second valve 122 is in line with the air path 116 and firing chamber 120, which will be described below.

When the control valve 112 is activated the gas from the front of the bolt mechanism 118 is allowed to exhaust to atmosphere back through air path 114 to the control valve 112 and to exhaust 124. Supply gas 110 is directed to the other side of the bolt mechanism via the control valve 112 via air path 123 in order to push the bolt mechanism 118 forward which loads a projectile into the firing position and allows communication of gas from the firing chamber 120 to the breech and the projectile.

When the control valve 112 is activated, the gas inside the firing chamber 120 is prevented from exhausting through the valve 112 due to position of a non-return valve 122. All the gas inside the firing chamber 120 is used to fire the projectile while the bolt mechanism 118 is in its firing position. When the bolt mechanism 118 is in the firing position, and the control valve 112 is actuated, no gas is supplied to the firing chamber 118. When the control valve 112 is deactivated, the bolt mechanism 118 is returned to its loading position and the firing chamber 120 is re-filled through air path 116 ready for the next cycle.

Figure 3:
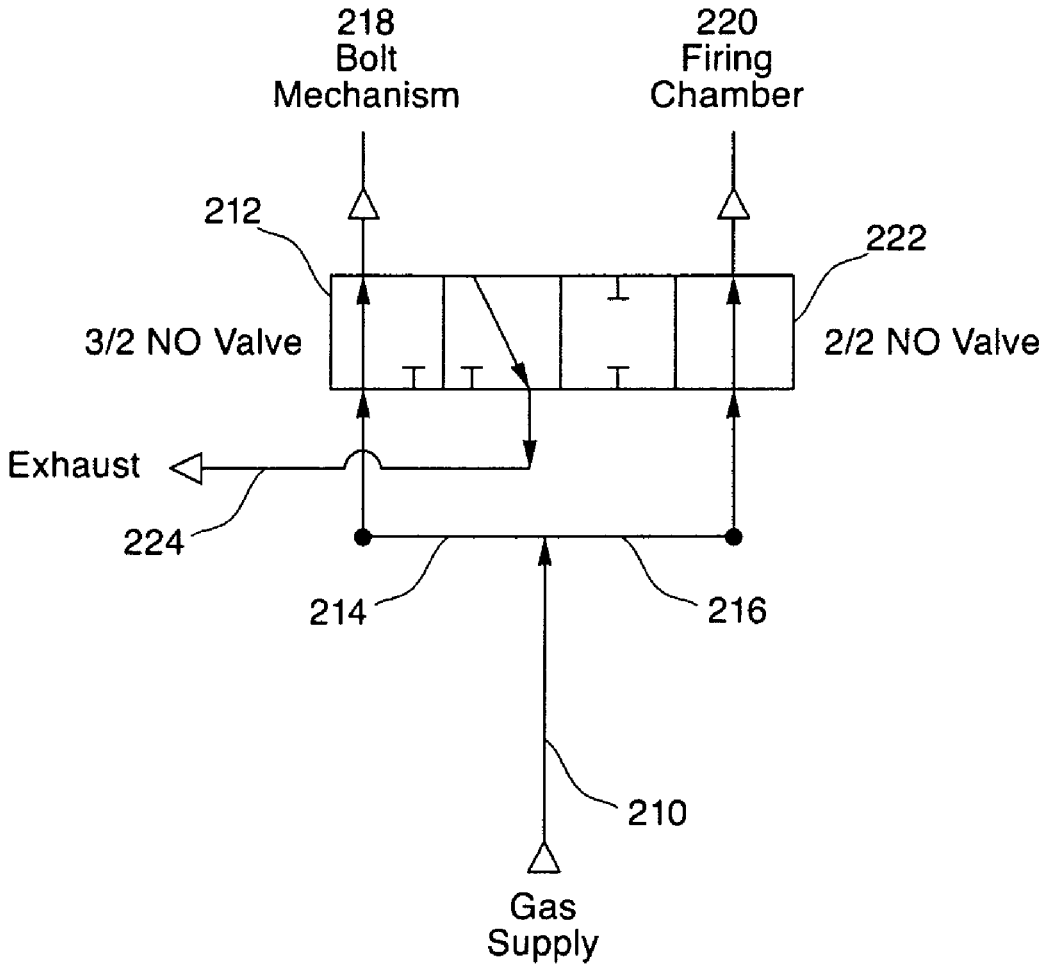
FIG. 3 is a diagram of a third embodiment of the pneumatic circuit of the method of the present invention.

Referring now to FIG. 3, a pneumatic circuit diagram of a third embodiment the method of the present invention is shown generally. Gasses are supplied 210 directly into a control valve 212 and a second valve 222 via a compressed gas supply and supply paths 214, 216. In this embodiment, the control valve 212 is a 3/2 solenoid valve and the second valve 222 is a 2/2 solenoid valve. Both valves 212, 222 have a normally open function.

The control valve 212 supplies gas to the bolt mechanism 118 and the second valve 222 supplies gas to the firing chamber 220.

When the control valve 212 is activated the gas from the bolt mechanism 218 is allowed to exhaust to atmosphere through the control valve 212 and to the exhaust 224. This feature allows the bolt mechanism 218 to move forward, which loads a projectile into the firing position and allows communication of gas from the firing chamber 220 to the breech and the projectile.

When the control valve 222 is activated, the gas inside the firing chamber 220 is preventing from exhausting doe to the operation of the 2/2 valve. All the gas inside the firing chamber is used to fire the projectile while the bolt mechanism 218 is in the firing position. When the bolt mechanism 218 is in the firing position, and the control valve 222 is actuated, no gas is supplied to the firing chamber 220. When the control valves 212 and 222 are deactivated, the bolt mechanism 218 is returned to its loading position and the firing chamber 220 is re-filled for the next cycle.

When the control valve 212 is activated, the gas inside the firing chamber 220 is prevented from exhausting through the valve 212 due to position of the second valve 222. All the gas inside the firing chamber 220 is used to fire the projectile while the bolt mechanism 218 is in its firing position. When the bolt mechanism 218 is in the firing position, and the control valve 212 is actuated, no gas is supplied to the firing chamber 218. When the control valve 212 deactivated, the bolt mechanism 218 is returned to its loading position and the firing chamber 218 is re-filled ready for the next cycle.

Therefore, it can be seen that the present invention provides a unique solution to the problem of minimizing waste gas in a paintball marker by providing a pneumatic circuit that controls the gasses released to the firing chamber and bolt mechanism. Furthermore, the pneumatic circuit of the present invention is more consistently reliable and does not increase the weight and size or complexity of a paintball marker.

It would be appreciated by those skilled in the art that various changes and modifications can be made to the illustrated embodiments without departing from the spirit of the present invention. All such modifications and changes are intended to be within the scope of the present invention except as limited by the appended claims.

What is claimed is:

1. A pneumatic circuit for use with a paintball marker having a gas supply, a bolt mechanism and a firing chamber, the pneumatic circuit comprising:
- an exhaust path;
- a gas supply inlet path in fluid communication to a gas supply;
- a first supply path in fluid communication with said gas supply inlet path and a bolt mechanism;
- a second supply path in fluid communication with said gas supply inlet path and a firing chamber;
- a first valve configured and arranged to selectively control fluid communication of said first supply path and said exhaust path; and
- a second valve configured and arranged to selectively control fluid communication of said second supply path between said gas supply and said firing chamber, said second valve located on said second supply path prior to said firing chamber.

2. The pneumatic circuit of claim 1, wherein said first valve is a solenoid valve.

3. The pneumatic circuit of claim 2, wherein said first valve is a 3/2 solenoid valve.

4. The pneumatic circuit of claim 2, wherein said first valve is 5/2 solenoid valve.

5. The pneumatic circuit of claim 1, wherein said second valve is a one-way non-return valve.

6. The pneumatic circuit of claim 1, wherein said second valve is a solenoid valve.

7. The pneumatic circuit of claim 6, wherein said second valve is a 2/2 solenoid valve.

8. A paintball marker, comprising:
- a gas supply;
- a bolt mechanism;
- a firing chamber; and
- a pneumatic circuit including:
  - an exhaust path;
  - a gas supply inlet path in fluid communication to said gas supply;
  - a first supply path in fluid communication with said gas supply inlet path and said bolt mechanism;
  - a second supply path in fluid communication with said gas supply inlet path and said firing chamber;
  - a first valve configured and arranged to selectively control fluid communication of said first supply path and said exhaust path; and
  - a second valve configured and arranged to selectively control fluid communication of said second supply path between said gas supply and said firing chamber, said second valve located on said second supply path prior to said firing chamber.

9. The pneumatic circuit of claim 8, wherein said first valve is a solenoid valve.

10. The pneumatic circuit of claim 9, wherein said first valve is a 3/2 solenoid valve.

11. The pneumatic circuit of claim 9, wherein said first valve is 5/2 solenoid valve.

12. The pneumatic circuit of claim 8, wherein said second valve is a one-way non-return valve.

13. The pneumatic circuit of claim 8, wherein said second valve is a solenoid valve.

14. The pneumatic circuit of claim 13, wherein said second valve is a 2/2 solenoid valve.

* * * * *